United States Patent [19]

Kotrba et al.

[11] Patent Number: 4,852,340

[45] Date of Patent: Aug. 1, 1989

[54] FIBER SEPARATING DEVICE

[75] Inventors: Zdeněk Kotrba, Tvardkova; František Jaros; Frantisek Buryšek, both of Dukla; Miloslav Kubovy, Hlavni; Jiri Hejduk, Nadrazni; Pavel Bures, Dukla, all of Czechoslovakia

[73] Assignee: Vyzkumny ustav bavlnarsky, usti nad Orlici, Czechoslovakia

[21] Appl. No.: 156,782

[22] Filed: Feb. 16, 1988

[30] Foreign Application Priority Data

Feb. 13, 1987 [CS] Czechoslovakia ..... 957-87

[51] Int. Cl.[4] ..... D01H 7/888; D01H 7/892

[52] U.S. Cl. ..... 57/301; 57/304; 57/411

[58] Field of Search ..... 57/300-302, 57/304, 305, 408, 411, 412

[56] References Cited

U.S. PATENT DOCUMENTS

| | | | |
|---|---|---|---|
| 3,439,488 | 4/1969 | Bucil et al. | 57/412 |
| 3,792,575 | 2/1974 | Doublebsky et al. | 57/301 |
| 3,884,028 | 5/1975 | Stahlecker et al. | 57/301 |
| 3,924,397 | 12/1975 | Stahlecker et al. | 57/301 |
| 3,938,310 | 2/1976 | Didek et al. | 57/412 |
| 3,959,961 | 6/1976 | Stahlecker | 57/301 |
| 3,986,327 | 10/1976 | Kobayashi | 57/301 |
| 4,201,037 | 5/1980 | Artzt et al. | 57/301 |
| 4,429,522 | 2/1984 | Ferkl et al. | 57/301 |
| 4,495,762 | 1/1985 | Junek et al. | 57/411 |
| 4,499,718 | 2/1985 | Junek et al. | 57/411 X |

*Primary Examiner*—John Petrakes
*Attorney, Agent, or Firm*—Klein & Vibber

[57] ABSTRACT

The invention solves the problem of ejecting impurities out of a cleaning aperture in the fiber separating device of an open-end rotor spinning unit, particularly when there are various contaminations of fibrous slivers and of different kinds of textile fibers being processed. For this purpose an air flow regulator is provided in the separating device in an air supply duct communicating with the cleaning aperture. According to the invention, the air flow regulator is provided with an air directing wall near the outlet of the air supply duct and thus directs air flow into the cleaning aperture toward the fiber opening cylinder.

10 Claims, 1 Drawing Sheet

FIBER SEPARATING DEVICE

FIELD OF THE INVENTION

The invention relates to a fiber separating device of an open-end rotor spinning unit. In particular, the invention relates to a fiber separating device of an open-end rotor spinning unit having a housing, a fiber opening cylinder accommodated in a cavity provided in the housing, a fiber feeding device arranged in a recess provided in the housing and communicating with the cavity, a fiber supply duct merging from the cavity, a cleaning aperture provided in the wall of the cavity and communicating with an impurity withdrawing duct, and an air supply duct leading to the cleaning aperture and provided with air flow regulating means.

BACKGROUND OF THE INVENTION

A problem to be coped with in such a device is how to ensure the processing of fibrous materials made from various sorts of textile fibers having different degrees of contamination. The fact that the pneumatic conditions are practically constant in the region of cleaning aperture is disadvantageous from the viewpoint of separation of impurities from materials of different types and contamination degrees and causes relatively considerable losses, due to fiber fly-off into the impurity withdrawing duct, in an effort to ensure the maximum impurity withdrawal.

According to U.S. Pat. No. 3,884,028 to Stahlecker et al for Apparatus for Removing Impurities from Fibers (the complete disclosure of which is incorporated herein by reference), it is known to provide air flow regulating means in the air supply duct which, however, is designed only for controlling or regulating the air amount flowing through said duct. This air regulating means is situated at the inlet of the air supply duct for adjusting the intensity of air flow sucked in from the ambient atmosphere. Thus, any throttling of air in this region results in an undesirable modification of air flow character in the region of the cleaning aperture and further on has unwanted effects on the air flow in the impurity withdrawing duct as well as in the air supply duct. In this way larger amounts of fibers fly off into the impurity withdrawal duct and accumulate in their transporting channels, which finally negatively influences the yarn quality.

It is an object of the present invention to eliminate the drawbacks of prior art as hereinabove referred to and to provide a device for separating impurities from variously contaminated fibrous materials made of different types of textile fibers.

Other co-assigned U.S. Patents disclosing related technology which could be helpful in understanding the present invention are: U.S. Pat. Nos. 4,429,552 (Open-end Spinning Machine); 4,495,762 (Apparatus for Separating Fibers in Open-end Spinning Units); and 4,499,718 (Apparatus for Separating Impurities from Open-end Spinning Units). The complete disclosures of these U.S. Patents is also incorporated herein by reference.

SUMMARY OF THE INVENTION

According to the invention, the air flow regulating means has an air directing wall which is arranged at the outlets of the air supply duct for directing an air flow into the cleaning aperture opposite the fiber opening cylinder.

An advantage of this inventive arrangement is that it enables the air amount to be adjusted as well as the air flow to be directed to the region of ejection of impurities through the cleaning aperture whereby also the transport of discrete fibers through the supply duct to the spinning rotor is positively influenced.

In one embodiment, an air directing wall is provided on a cylindrical regulating pin pivoted in at least one wall of the air supply duct, the height of the directing wall corresponding to that of said duct.

In another embodiment, an air directing wall is provided on a regulating segment journalled about a pivot, the outlet edge of the air directing wall forming the outlet of the air supply duct.

The above embodiments of the invention are relatively simple and easy to manufacture. Moreover, they can be very easily manipulated in operation.

BRIEF DESCRIPTION OF THE DRAWING

With these and other objects in view which will become apparent in the following detailed description, the present invention, which is shown by example only, will be clearly understood in connection with the accompanying drawing, in which.

DESCRIPTION OF THE PREFERRED EMBODIMENTS

Figure 1:
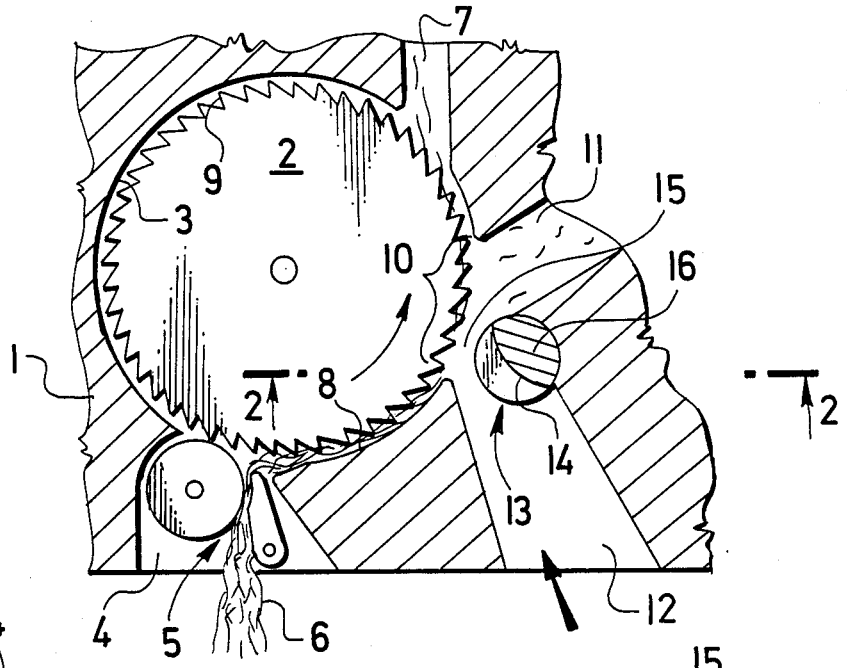
FIG. 1 shows a sectional view of the housing of the fiber separating device together with a cleaning aperture, communicating ducts and an air flow directing wall.

Referring now to FIG. 1, the fiber separating device of an open-end rotor spinning unit is accommodated in a housing 1 having a cavity 3 in which a fiber opening cylinder 2 is arranged. The cavity 3 communicates with an inlet recess 4 accommodating a device 5 for feeding a fibrous sliver 6 to the opening cylinder 2 as well as with a supply duct 7 for conveying the separated fibers to a spinning rotor (not shown). A part of the peripheral wall 8 of the cavity 3 is interrupted to from a cleaning aperture 10 communicating with an impurity withdrawing duct 11 and with an air supply duct 12. The latter opens at the beginning of the cleaning aperture 10 and of the withdrawing duct 11.

In the air supply duct 12, there is provided an air flow regulator 13 having an air directing wall 14 which is positionally adjustable and situated at the outlet 15 of the duct 12 or in the proximity thereof in order to direct the flow of supplied air on its way to the opening cylinder 2.

Figure 2:
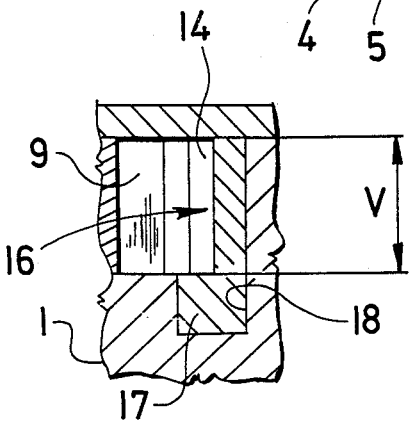
FIG. 2 is a sectional view of the directing wall taken along line II—II in FIG. 1.

FIG. 1 shows an embodiment of the air directing wall 14 which is provided on a cylindrical regulating pin 16 pivoted by its cylindrical end portion 17 (see FIG. 2) in a cylindrical hole 18 in the housing 1. The height V of said wall 14 corresponds to that of the air supply duct 12.

Figure 4:
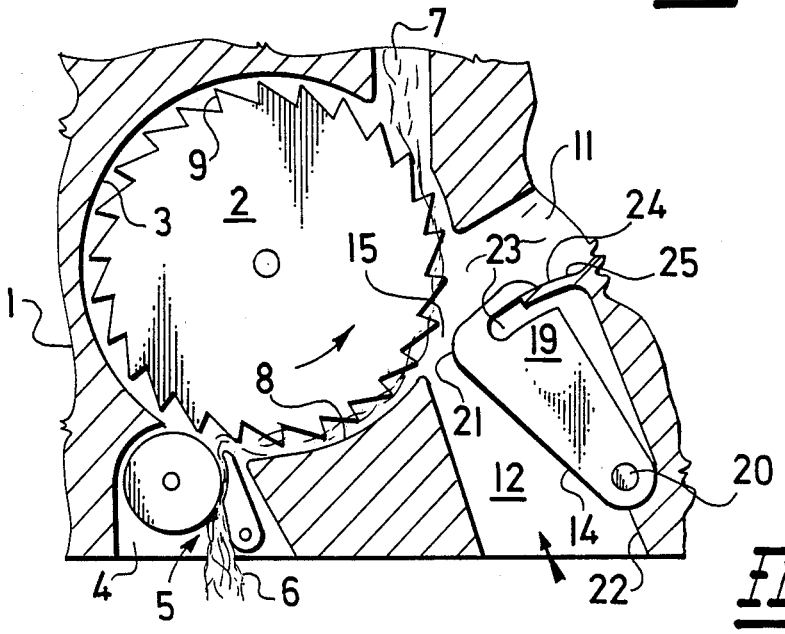
FIG. 4 shows another embodiment of air flow regulating means having the directing wall on a regulating segment.

FIG. 4 shows another embodiment where the regulating wall 14 is provided on a regulating segment 19 mounted for swinging about a pivot 20. The directing wall 14 terminates in an outlet edge 21 which defines the outlet 15 of the air supply duct 12.

The air directing wall 14 on the cylindrical pin 16 as well as on the regulating segment 19 is preferably situated at the wall 22 of air supply duct 12 which merges into the impurity withdrawing duct 11 and is opposite to the wall adjacent the opening cylinder 2.

Figure 3:
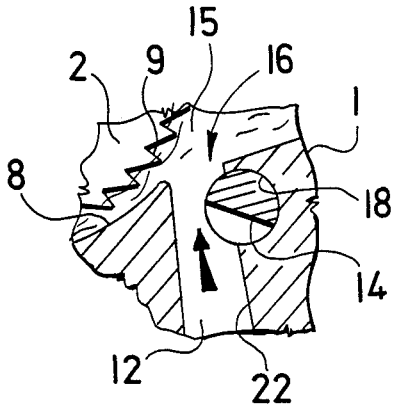
FIG. 3 is a detailed, corresponding to FIG. 1, but of another embodiment of the directing wall.

The air directing wall 14 can be convex (FIG. 1) or concave but preferably is flat (FIG. 3). In the latter case the wall 14 should be in such a configuration that in its inoperative position it is aligned with the respective wall 22 of the air supply duct 12 (FIG. 3).

Referring again to the embodiment of FIG. 4, at the outlet edge 21, the regulating segment 19 is preferably provided, at the side opposite the regulating wall 14, with a longitudinal slit 23 for a projection 24 outstanding from the wall 25 of the impurity withdrawing duct 11. In this way the space between the wall of the regulating segment 19 and the adjacent wall 22 of the air supply duct 12 is tightly closed in any of the operating positions of said segment 19.

Manner of Operation

In operation, the sliver 6 of fibrous material is supplied by the feeding device 5 to the rotary opening cylinder 2 by which the fibers are individualized and transported on its active surface 9 past the cleaning aperture 10 into the fiber supply duct 7 and further on to the spinning rotor. Impurities released in the fiber individualizing process are ejected through the cleaning aperture 10 into the withdrawing duct 11. Since a subatmospheric air pressure prevails in the spinning rotor and since the withdrawing duct 11 is coupled to a vacuum source for withdrawing impurities, the individualized fibers tend, also due to centrifugal force, to leave the active surface 9 of the cylinder 2 in the cleaning aperture 10. By appropriately directing the supplied air flow and by simultaneously adjusting its amount in the air supply duct 12 by means of the directing wall 14, there can be achieved an optimum separation of impurities from the flow of discrete fibers. By directing the air flow by means of the directing wall 14, it is also possible to avoid some unstable cleaning effects as to impurity withdrawal and fiber fly-off in the region of the cleaning aperture. Moreover, aerodynamic turbulence and formation of dust deposits downstream of the regulating pin 16 and the regulating segment 19, respectively, are eliminated, and the thread breakage rate due to fiber accumulation is substantially reduced if compared with an open-end spinning unit not provided with this flow regulation at the outlet of the air supply duct 12.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A fiber separating device comprising a housing, said housing having a cavity and a recess;

a fiber opening cylinder accommodated in said cavity;

a fiber feeding device arranged in said recess and communicating with said cavity;

a cleaning aperture provided in a wall of said cavity and communicating with an impurity withdrawing duct, and an air supply duct having an inlet and an outlet, said outlet leading to said impurity withdrawing duct;

said air supply duct being provided with air flow regulating means, said air flow regulating means having a regulating wall which is arranged proximate to the outlet of the air supply duct for regulating the direction of air flow into the cleaning aperture toward the fiber opening cylinder and for regulating the amount of air passing through said air supply duct.

2. A fiber separating device as claimed in claim 1, wherein the regulating wall is provided on a cylindrical regulating pin pivoted in a wall of the air supply duct, the height of said regulating wall corresponding to that of said air supply duct.

3. A fiber separating device as claimed in claim 2, wherein the regulating wall is planar.

4. A fiber separating device as claimed in claim 2, wherein the regulating wall is rounded.

5. A fiber separating device as claimed in claim 1, further comprising a regulating segment and a pivot;

the regulating wall being provided on said regulating segment journalled about said pivot, an outlet edge of said regulating wall forming the outlet of the air supply duct, said regulating wall merging into said impurity withdrawing duct.

6. A fiber separating device as claimed in claim 5, wherein the regulating segment is provided with a longitudinal slit adjacent its outlet edge opposite the regulating wall, a wall of said impurity withdrawing duct being provided with an outstanding projection, said projection engaging said slit.

7. A fiber separating device as claimed in claim 5, wherein the regulating wall is planar.

8. A fiber separating device as claimed in claim 1, wherein the regulating wall is planar.

9. A fiber separating device as claimed in claim 1, wherein the regulating wall is rounded.

10. A fiber separating device comprising a housing, said housing having a cavity and a recess;

a fiber opening cylinder accommodated in said cavity;

a fiber feeding device arranged in said recess and communicating with said cavity;

a cleaning aperture provided in a wall of said cavity and communicating with an impurity withdrawing duct, and an air supply duct having an inlet and an outlet, said outlet being adjacent to said cleaning aperture and said impurity withdrawing duct;

said air supply duct being provided with air flow regulating means, said air flow regulating means having a regulating wall which is arranged proximate to the outlet of the air supply duct for regulating the direction of air flowing into the cleaning aperture toward the fiber opening cylinder.

* * * * *